United States Patent [19]

Miles

[11] 4,235,587

[45] Nov. 25, 1980

[54] FLAME RESPONSIVE CONTROL CIRCUIT

[75] Inventor: Gregory M. Miles, Minneapolis, Minn.

[73] Assignee: Honeywell Inc., Minneapolis, Minn.

[21] Appl. No.: 27,964

[22] Filed: Apr. 9, 1979

[51] Int. Cl.[3] ..... F23N 5/08

[52] U.S. Cl. ..... 431/73; 431/68; 431/78

[58] Field of Search ..... 431/24, 25, 68, 69, 431/70, 71, 72, 73, 74, 75, 76, 77, 78, 79

[56] References Cited

U.S. PATENT DOCUMENTS

| | | | |
|---|---|---|---|
| 2,906,928 | 9/1959 | Klein . | |
| 3,270,800 | 9/1966 | Deziel | 431/69 |
| 3,425,780 | 4/1969 | Potts | 431/68 |
| 3,425,780 | 2/1969 | Potts . | |
| 3,514,240 | 5/1970 | Potts . | |
| 3,816,053 | 6/1974 | Cade | 431/78 |
| 3,818,285 | 6/1974 | Carson . | |
| 3,829,981 | 7/1975 | Bauer | 431/78 |
| 3,832,123 | 8/1974 | Walbridge . | |
| 3,852,729 | 12/1974 | Cade . | |
| 3,930,783 | 1/1976 | Bauer | 431/78 |
| 3,947,218 | 3/1976 | Landis . | |
| 4,000,961 | 1/1977 | Mandock . | |
| 4,088,984 | 5/1978 | Muramoto | 431/78 |
| 4,178,149 | 11/1979 | Matthews | 431/78 |

*Primary Examiner*—George E. Lowrance
*Attorney, Agent, or Firm*—Alfred N. Feldman

[57] ABSTRACT

A flame responsive control circuit means has been disclosed which responds to the flame in a burner. The response is to the sudden rate of change of the resistance or impedance of a photocell upon the loss of flame. The two embodiments disclosed both utilize a rate of change sensing means to determine that a loss of flame has occurred. If a loss occurs, ignition is reinstituted immediately and the system either operates normally or locks itself out in a safety shut down.

14 Claims, 2 Drawing Figures

FLAME RESPONSIVE CONTROL CIRCUIT

BACKGROUND OF THE INVENTION

In recent years the method or mode of operating fuel burners has been altered because of the escalating cost of fuel. Until recent years, fuel burners, particularly oil burners, were operated with an intermittent source of ignition, a source of combustion air, and the continuous monitoring of a flame by a sensor. The sensor normally was a cadmium sulfide type of cell. The control devices themselves generally were large and utilized electromechanical components.

In the older types of fuel burners or oil burners, the operation of the ignition source occurred whenever fuel was introduced into the combustion chamber. This type of operation was generally considered as quite safe as there was little chance of the flame going out and there being no source of ignition to reignite the fuel. Also, there was little or no problem with the photocell or sensor being fooled by a hot refractory wall of the oil burner. The overall monitoring of the operation of the system relied both on the operation of the photocell and on a safety switch which ultimately would remove the power to the source of oil and ignition in the event of the loss of a flame. The loss of a flame was normally sensed by the photocell and even though the photocell had a relatively slow response time, the source of ignition was still "on" to prevent any build up of oil.

In order to accomodate for the higher operating costs, fuel burners of the oil burner type are now more commonly operated with an interrupted source of ignition. The quality of the fuel being used now varies considerably, as opposed to a more uniform quality of fuel that was available a number of years ago. This variation in fuel quality and the interrupted operation of an ignition source provides a potential for the loss of flame which is less stable under present operating conditions than under the older operating conditions. In the event of the loss of a flame when the ignition source has been turned "off", the photocell requires a short period of response time. This response time can be extended or exaggerated by a hot refractory wall of the burner. During such a loss of flame when no ignition source is present and with a hot refractory wall present, the oil burner might introduce oil that was not properly ignited and create an unsafe condition before a safety switch caused the shut down of the burner. In order to overcome this unsafe operating mode for an oil burner, it has become necessary to improve the response time to the photocell that is used to sense the existance of flame.

SUMMARY OF THE INVENTION

The present invention is directed to a generally solid state oil primary control with an improved response in the event of a loss of flame in the burner. The present invention is a flame responsive control circuit means that is adapted to be connected to a flame responsive cell means such as a cadmium sulfide photocell. The control circuit means is provided with an improved, rapid response to the loss of flame in a burner, such as an oil burner, by responding to the rate of change of the resistance or impedance of the photocell itself. This response to a rate of change allows the flame responsive control circuit means to respond long before the resistance of the cell would reach a level where an absolute potential or reference type of operating circuit would respond.

It has been found in studying the response curve of the flame responsive cell means that as soon as the main flame in a burner is extinguished, the impedance of the cell immediately rises sharply. In order to prevent false flame signal responses, an absolute potential level for operating the flame responsive control circuit has been provided in prior devices at some levels significantly above the immediate reaction of the impedance to a flame out. In burner installations with a high refractory visibility, the change to the absolute control level by the photocell may take a few seconds due to the radiation that the cell receives from the hot refractory prior to the refractory cooling after the loss of flame.

The present invention relies on sensing the sudden rate of change of the resistance or impedance of the photocell to indicate that a flame has been lost. This type of a device is not responsive to the refractory radiation which might otherwise delay the safe shut down of an associated oil burner. In the present invention the loss of a flame is immediately sensed by the flame responsive control circuit means by the use of a rate of change sensing means that immediately responds to the sudden change in the impedance of the photocell when the flame is extinguished. With an immediate response to the loss of flame the source of ignition, which has been operated as an interrupted ignition, can be reinitiated to either re-establish a flame or to maintain ignition until an associated safety switch circuit shuts down the entire device in a safe manner.

DESCRIPTION OF THE PREFERRED EMBODIMENTS

Figure 1:
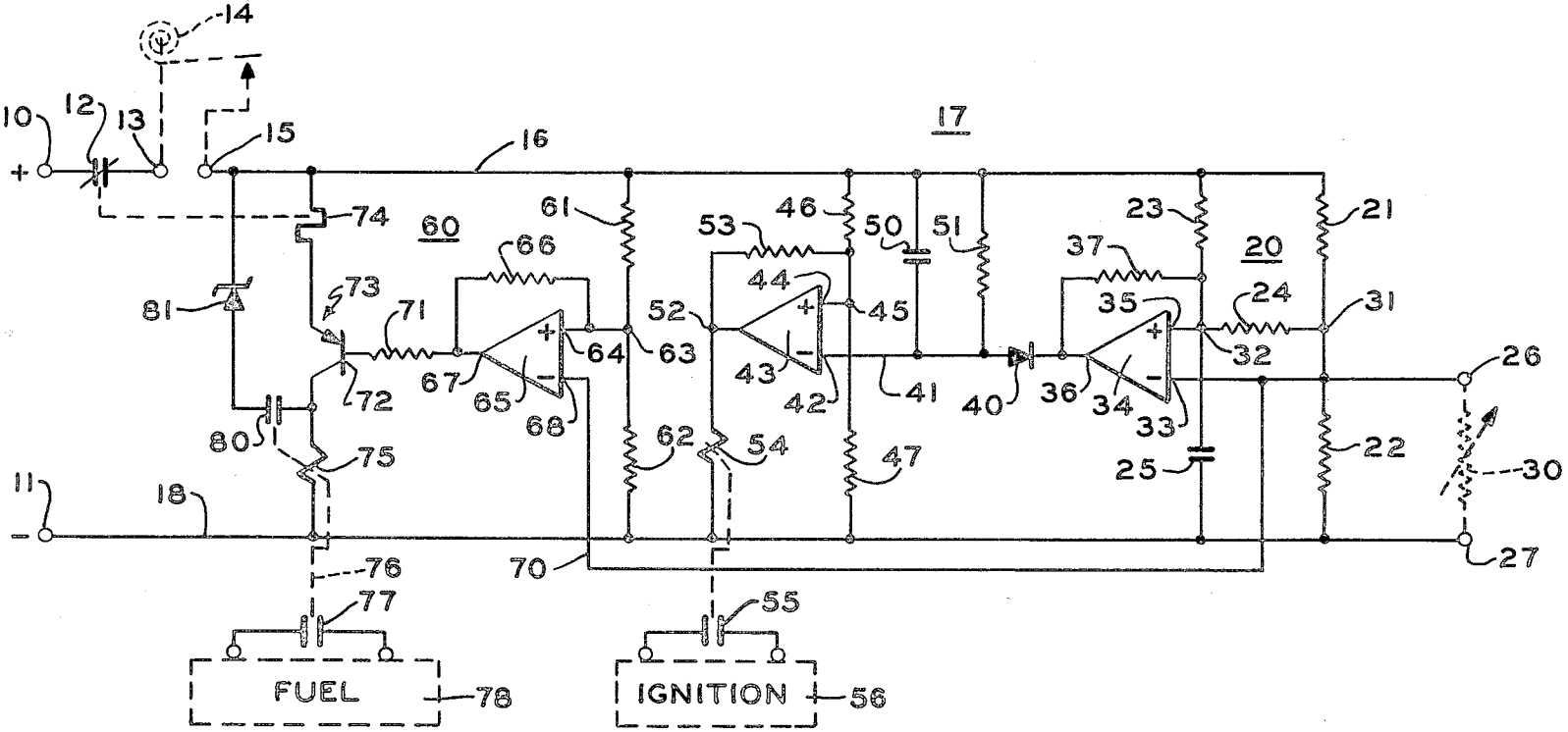
FIG. 1 is a schematic circuit of part of an improved oil burner control or flame responsive control circuit means.

A first embodiment of an improved interrupted ignition flame responsive circuit control means is disclosed in FIG. 1. The embodiment of FIG. 1 is adapted to be connected to a fuel burner, and more particularly to an oil burner. Portions of a fuel or oil burner have been disclosed but is should be understood that not all of the components that necessarily make up a complete installation have been identified.

A souce of direct current is applied to a pair of terminals 10 and 11 for the control circuit means disclosed in FIG. 1. The voltage between terminals 10 and 11 would be a form of regulated and filtered direct current. Terminal 10 is connected through a normally closed safety switch contact 12 to a terminal 13. Terminal 13 is adapted to be connected to a control means such as a thermostat 14 which has its other side connected to a terminal 15. The closing of the thermostat 14 applies the direct current potential from terminal 13 to the terminal 15 where it is in turn supplied to a common conductor 16 for the flame responsive control circuit means generally disclosed at 17. The terminal 11 connected to the negative potential of the applied direct current is connected to a conductor 18 which forms a common for the control circuit means 17.

Connected between the conductor 16 and 18 are a number of components that will now be enumerated. A bridge 20 is made up of a group of resistors 21, 22, 23 and 24 and a capacitor 25. The resistor 22 is connected to a pair of terminals 26 and 27 across which is connected a cell means 30. The cell means 30 is a flame responsive cell means that varies its impedance with its exposure to the light from a flame. Typically the cell means 30 would be a cadmium sulfide cell which changes resistance from a relatively high resistance in a dark ambient to a low resistance of approximately two hundred ohms when viewing a flame. The light resistance of the cell means 30 could rise as high as approximately one thousand ohms in some applications and one thousand ohms generally is considered to be the highest practical application level for a cadmium sulfide cell in a working system. The resistance 22 which parallels the cell means 30 typically would be in the order of two thousand ohms or higher, but its value is variable depending on the type of installation. The value of the resistance 22 must be higher than the resistance of cell means 30 when the cell means 30 is exposed to a flame in a fuel burner.

The resistors 21, 22, and 24 have a common connection or node 31, while the resistors 23 and 24 along with the capacitor 25 have a common connection or node 32. The connection 31 is connected to the inverting terminal 33 of an operational amplifier generally disclosed at 34. The operational amplifier 34 has a non-inverting terminal 35 which is connected to the junction 32. The operational amplifier 34 further has an output 36 and a feed back resistor 37 which is connected between the output 36 and the non-inverting terminal 35 to provide a positive feed back for causing the operational amplifier 34 to act as a switch.

The output 36 of the operational amplifier 34 is connected to a diode 40 which in turn is connected to a conductor 41 that forms an input to an inverting terminal 42 of a further operational amplifier 43. The operational amplifier 43 has a non-inverting terminal 44 that is connected to a junction 45 between a pair of resistors 46 and 47 that form a voltage divider to establish an operating point for the operational amplifier 43. Also connected between the conductor 41 and the conductor 16 is a capacitor 50 and a resistor 51 that will provide a time delay function, as will be explained in connection with the operation of the device. The operational amplifier 43 has an output 52 that is connected through a resistor 53 to the non-inverting terminal 44 of the operational amplifier 43 to again provide a positive feed back to make the operational amplifier 43 a switch.

The output 52 of the operational amplifier 43 is connected to a relay 54 that in turn is connected to the common conductor 18. The operation of the relay 54 operates at least one normally open contact 55 that is used to control an ignition means generally disclosed at 56. The ignition means 56 is, in an oil burner, normally a transformer or a solid state spark generating means. The type of ignition means 56 is not material to the invention but is shown as part of the fuel burner or oil burner means for which the present control circuit means provides an operating control. It is quite clear that whenever the relay 54 is energized by the operational amplifier 43 having a high output voltage that the relay contact 55 closes to energize the ignition means 56.

A fuel control means is generally disclosed at 60 for the present control circuit means 17, and includes a voltage divider network made up of resistor 61 and 62 which have a common junction 63 that is in turn connected to an input 64 of an operational amplifier 65. The non-inverting input 64 is also connected through a resistor 66 to an operational amplifier output 67 to provide a positive feed back so that the operational amplifier 65 is a switch. The operational amplifier 65 further has an inverting input 68 that is connected to a conductor 70 that in turn is connected back to the junction 31 which is common to the resistors 21, 22, and 24 at the terminal 26 of the cell means 30. It is thus apparent that the operational amplifier 65 receives a direct input signal from the cell means 30 and which is not related to the signal that is supplied by the bridge means 20 to the operational amplifier 34 and 43.

The operational amplifier output 67 is connected through a resistor 71 to a base 72 of a transistor generally disclosed at 73. The transistor 73 has its emitter connected through a safety switch heater element 74 to the conductor 16. Its collector is connected through a relay 75 to conductor 18, and the relay further has a linkage 76 to a normally open contact 77 that controls a source of fuel generally disclosed at 78. The source of fuel 78 typically would be an oil valve and a source of burner air driven by a motor. Whenever the contact 77 is closed fuel and air are supplied by the fuel source 78 to function with the ignition means 56 to form a conventional fuel burner or oil burner.

The relay 75 has a further normally open contact 80 that is connected from the collector of the transistor 73 through a zener diode 81 to the conductor 16. The closing of the contact 80 by the relay 75 directly connects the potential on conductor 16 through the zener diode 81 to the relay 75 to latch the relay into an operative state. The reason for this latching arrangement will be described in the subsequent description of the operation of the device.

OPERATION OF FIG. 1

The normal operation of the flame responsive control circuit means 17 will first be described and then the novel function will be detailed. With the safety switch 12 closed, the closing of the thermostat or control switch 14 applies the direct current potential between the conductors 16 and 18 to energize the entire device. At this particular time the cell means 30 is exposed to a dark burner and has a very high resistance, normally in the many thousands of ohms. The bridge means 20 has potential applied to it immediately and the capacitor 25 is completely discharged. Since the capacitor 25 is discharged there is a very low voltage at the junction 32 and a higher voltage at the junction 31. This difference in voltage is applied to the terminals 33 and 35 and the operational amplifier 34 is switched to a low value thereby pulling the output 36 near to the potential on the conductor 18. This allows current to flow through the resistor 51 and the capacitor 50. The voltage on the conductor 41 is compared at the input to the inverting terminal 42 against and immediately appearing voltage at the junction 45 that is provided by the voltage divider 46 and 47. Since the output 36 of the operational amplifier 34 is near the voltage of the conductor 18, the voltage on the conductor 41 is substantially the negative voltage on conductor 18. The operational amplifier 43 has a relatively high differential voltage applied to it such that the operational amplifier 43 switches its output 52 to the higher voltage on conductor 16. This relatively high voltage causes the relay 54 to immediately pull in and close the contact 55 to initiate the ignition means 56.

At this same time the relatively high voltage appearing at the junction 31 is applied on the conductor 70 to the inverting terminal 68 of the operational amplifier 65. The relatively high voltage appearing on the inverting terminal 68 causes the operational amplifier output 67 to switch low to approximately the voltage on conductor 18. This pulls the base 72 of the transistor 73 to a relatively low potential and the transistor 73 is driven into conduction. This immediately draws current through the safety switch heater 74, the transistor 73, and the relay 75. The relay 75 pulls in and closes the contact 77 to energize the fuel means 78 thereby supplying air and oil to the burner. Since the ignition has also been turned "on", the supplying of fuel to the burner should initiate operation of a normal cycle immediately. The operation is completed by the relay 75 closing the contact 80 thereby latching in the relay 75 so that it can only be dropped out by the removal of the potential from the relay 75. During this time the safety switch heater 74 begins the heating in a normal trial for ignition of a burner.

As soon as a flame appears, the cell means 30 drops to a very low resistance and the potential at the junction 32 has risen due to the charging of the capacitor 25. The relatively low resistance of the cell means 30 combined with the resistance 22 in parallel causes the operational amplifier 34 to now switch its output 36 to a high potential thereby back biasing the diode 40. Back biasing of the diode 40 allows the capacitor 50 to start to discharge through the resistance 51 to provide a time delay which holds the ignition 56 in an energized state. As soon as the time delay effect of the discharge of capacitor 50 through the resistor 51 is accomplished, the voltage at the inverting terminal 42 no longer controls the operational amplifier 43, but the voltage from the voltage divider network made up of resistors 46 and 47 cause the non-inverting terminal 44 to cause the operational amplifiers output 51 to switch high. The switching high after the time delay interval causes the contact 55 to open thereby removing the ignition and providing an interrupted ignition system for the oil burner. Operational amplifier 65 has switched high to turn "off" current through transistor 73 and heater element 74.

The description of operation to this point has been the normal sequence in a burner where no flame out has occurred. If a flame failure occurs in the burner, the cell means 30 will start to rise in resistance value. Its rise initially will be quite sharp and it will gradually taper off in its rise as it continues to respond to the cooling of the hot refractory background of the burner. If the system were allowed to operate strictly on the absolute value of impedance or resistance of the cell means 30, a substantial time delay could occur from a flame out to the time the ignition is reinstituted. The present invention alleviates and removes that problem. The sudden rise in the resistance of the cell means 30 is immediately coupled from the terminal 26 and junction 31 to the inverting terminal 33 of the operational amplifier 34. The sudden rate of rise is sensed by the resistance and capacitance configuration of the bridge 20 to cause the operational amplifier 34 to immediately switch low. The inverting terminal 42 of the operational amplifier 43 to be drawn to a low potential immediately thereby causing the operational amplifier 43 to again switch high and re-energize the ignition 56 by pulling in the relay 54. The rate of change sensing means in the input of the operational amplifier 34 keeps the relay 54 energized for a long enough period of time for either one of two things to happen. Either a flame is re-established and the cell means 30 drops to a low resistance, or the ambient refractory sensed by the cell means 30 allows the cell resistance to rise high enough so that the operational amplifier will keep the ignition 56 energized. If the flame is not re-established, the relatively high absolute value of potential on conductor 70 from the junction 31 causes the operational amplifier 65 to switch its output 67 to a low state thereby causing the transistor 73 to start conducting. If the transistor continues to conduct for any period of time the safety switch heater 74 is activated and opens the contact 12 to drop out the entire system. The safety switch mechanism is a type of mechanism which requires manual reset and advises of a fault which requires human intervention.

It is thus apparent that the present system utilizes a rate of change sensing means which controls the ignition and is combined with an absolute potential level control for the fuel control means 60. The present system recognizes the loss of flame by the immediate sharp rate of rise of the impedance or resistance of cell means 30 and utilizes this rate of change through the rate of change sensing means to provide for safe reignition and subsequent shut down of the fuel burner.

Figure 2:
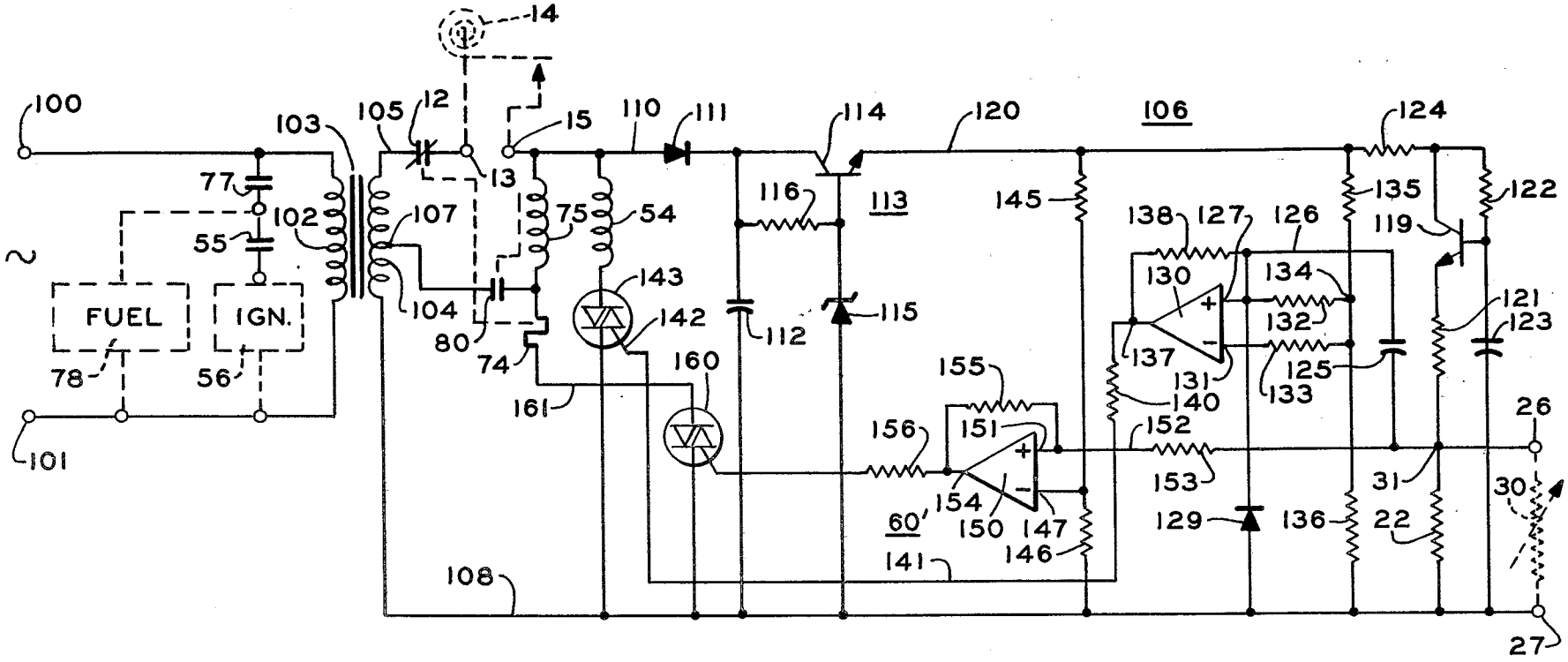
FIG. 2 is a schematic circuit of a complete oil burner control circuit using a second embodiment of the invention.

In FIG. 2 a second embodiment of the present flame responsive control circuit means is disclosed. To the extent possible, similar items will carry the same reference numbers as used in FIG. 1.

A pair of terminals 100 and 101 are connected to a source of alternating current such as a common line voltage. The terminals 100 and 101 are connected to a primary winding 102 of a transformer 103 which has a tap secondary 104. Connected across the conductors from the terminals 100 and 101 to the primary winding 102 are relay contacts 77 and 55 which supply power to the ignition means 56 and the fuel and air source means 78. The relay contacts and the fuel burner or oil burner elements are the same in the embodiment of FIG. 2 as in FIG. 1.

The secondary tapped winding 104 is connected to a common conductor 105 that in turn is connected through a safety switch contact 12. The safety switch 12 is connected to a terminal 13 and a control means or a thermostat 14 along with a terminal 15 to supply an energizing source for an interrupted ignition flame responsive control circuit means generally disclosed at 106. The tapped transformer secondary 104 has a winding connection 107 and a common conductor 108. The transformer 103 uses a step down winding 104 to provide a low voltage for safety and convenience in operating the present flame responsive control means 106 in a low voltage control mode as is common in the industry.

The flame responsive control means 106 has a pair of terminals 26 and 27 across which is connected a cell means 30. The cell means 30 is again a variable impedance or resistance and could be a cadmium sulfide cell as in FIG. 1. Connected across the terminals 26 and 27 is the parallel resistor 22 that again typically would be in the range of two thousand ohms. The overall potential supplied for the flame responsive control means 106 is accomplished by the terminal 15 being connected by a conductor 110 which is connected to a diode 111 and a capacitor 112 which forms a direct current supply for the circuit means 106. The capacitor 112 is connected to the common conductor 108 in a conventional fashion. A voltage regulating means 113 is disclosed made up of the transistor 114, a zener diode 115, and a resistance 116 with the transistor 114 connected so that its acts as a variable impedance to supply a well regulated voltage on a conductor 120 with respect to the conductor 108 for the electronics of the actual control circuit means 106.

The voltage on conductor 120 is supplied to a transistor 119 which is connected with its collector-emitter circuit through a resistor 121 to the resistor 22. A further resistor 122 and a capacitor 123 are connected across the source of potential along with a dropping resistor 124 to provide input power for the flame responsive control means 106. It is understood that when the transistor 119 is conducting that a voltage will appear at the junction 31 which is common to the cell means 30 and the resistor 22. The junction 31 provides some of the same functions as in FIG. 1 as will be described in connection with the operation of FIG. 2.

Junction 31 is connected to one side of a capacitor 125 that is in turn connected by a conductor 126 to a non-inverting terminal 127 of an operational amplifier 130. The operational amplifier 130 has an inverting terminal 131. The inputs 127 and 131 are connected directly to two resistors 132 and 133 which are of the same numerical value. Both of the resistors 132 and 133 are connected at a common point 134 between two resistors 135 and 136. When power is supplied to the control circuit means 106 a voltage appearing at the junction 134 is directly applied to both the non-inverting terminal 127 and the inverting terminal 131 of the operational amplifier 130. A diode 129 clamps the non-inverting terminal 127. The operational amplifier 130 has an output at 137 which is connected by a resistor 138 back to the non-inverting terminal 127 to form a switch.

The output 137 of the operational amplifier 130 is connected through a resistor 140 to a conductor 141 and then in turn is connected to the gate 142 of a triac 143. The triac 143 is connected in series with the relay 54. Relay 54 is the same relay as disclosed in FIG. 1. It is apparent that whenever the triac 143 conducts that the relay 54 is energized and that it controls the contact 55 to the ignition means 56.

The system is completed by a fuel control means generally disclosed at 60'. The fuel control means 60' is made up by providing a circuit very similar to that disclosed in FIG. 1. A voltage divider network made up of resistors 145 and 146 provide a common input to the inverting terminal 147 of an operational amplifier 150. The operational amplifier 150 has a non-inverting terminal 151 that is connected by a conductor 152 and a resistor 153 to the junction 31 to receive the absolute potential that appears at the cell means 30. The operational amplifier 150 has an output 154 and a feed back resistor 155 to provide for switching of the operational amplifier. The output 154 is connected through a resistor 156 to a second triac 160. The triac 160 is connected by a conductor 161 to the safety switch heater element 74 and the relay 75 as was disclosed in connection with the burner in FIG. 1. Again the relay 75 has a normally open contact 80 that is used to latch the relay into an operative state by connecting it to conductor 107 whenever the relay 75 operates.

OPERATION OF FIG. 2

The operation of the present fuel burner control in many respects is the same as in FIG. 1. As a result of that only a brief description of the similar functions will be provided. The thermostat 14 closes and supplies power to the conductor 120 of a regulated nature due to the voltage regulating means 113. At the time that this power supplied the capacitor 123 is discharged and the junction 31 is at a very low potential. With 123 discharged, the base of the transistor 119 is low and the transistor does not conduct until the capacitor 123 takes on a charge. The operation of the circuit utilizing the transistor 119, the resistor 122, and capacitor 123, the resistor 121 forms a circuit that removes the ripple, if any of the supply to the cell means 30. This circuit is optional in the use of the present invention. The eventual conduction of transistor 119 provides a voltage drop across the resistor 121 and 122 to provide a rising voltage at the junction 31. This rising voltage reflects the fact that the resistance of a cell means 30 is high in a dark ambient. The rising voltage at junction 31 is coupled through the capacitor 125 to the non-inverting terminal 127 of the operational amplifier 130. When the system was initially energized, the two equal resistances 132 and 133 provided the same voltage levels at the inverting terminal 131 and the non-inverting terminal 127. As a result of this, the operational amplifier 130 initially is caused to react to the current that is driven through the capacitor 125 and subsequently through the resistor 132 back to the ground conductor 108. This generates a more positive potential at the non-inverting terminal 127 than at the inverting terminal 131, and the operational amplifier 130 switches its output 137 to a high voltage level. This high voltage level is coupled by the conductor 141 to the gate 142 of the triac 143. The triac 143 then starts to conduct and supplies a current through a relay 54 so that the relay 54 is energized pulling in the contact 55 to energize the ignition means 56. It can thus be seen that the initial reaction of the present system in driving current through the capacitor 125 and through the resistor 132 causing a positive potential at the non-inverting terminal 27 is to energize the ignition means 56.

At the same time that this was occurring the absolute potential or voltage at the junction 31 is directly connected by conductor 152 and the resistor 153 to the non-inverting terminal 151 of the operational amplifier 150. This voltage is sufficient with respect to the voltage on the inverting terminal 147 to cause the output 154 of the operational amplifier 150 to switch high. This causes a potential to be coupled through the resistor 156 to the triac 160 thereby causing the triac 160 to conduct. Current is pulled through the relay coil 75, the safety switch heater 74, and the triac 60. This immediately causes the relay 75 to lock itself in through the contact 80 and to start heating the safety switch heater 74. The operation of the relay 75 also closes the contact 77 thereby energizing the fuel means 78 to supply fuel along with ignition means 56. The normal operation would be for the burner to establish a flame and for the cell means 30 to drop sharply in resistance.

The drop in resistance of the cell means 30 causes the charge on the capacitor 125 to flow in a reverse direction from that which it provided initially. The discharge of the capacitor 125 to the lower resistance of the cell means 30 causes a current to flow through the resistor 132 such that a positive potential is generated at the right side of the resistor 132 thereby driving the non-inverting terminal 127 lower than the inverting terminal 131 and causing the operational amplifier 130 to switch its output 137 to a low value. This removes the gating potential from the triac 143 and the relay 54 is dropped out thereby removing the ignition. This is the normal run condition for the device.

Once again the present system is responsive to a rate of change of the cell means 30 in the event of a flame out. In the event that flame is lost the cell means 30 has a sharp initial rise in resistance value. This initial sharp rise is very similar to the rise that occurs at start up and the rise causes the voltage at junction 31 to rise with respect to that which existed when the system was operating with a flame in the burner. The rise in the voltage at junction 31 forces current through the capacitor 125 in an upward direction thereby causing a voltage drop across the resistor 132 so that a more positive potential is applied to the non-inverting terminal 127 than is present at the inverting terminal 131. The operational amplifier 130 immediately switches its output 137 high and a voltage is again supplied through the resistor 140 to the triac 143 to pull in the ignition relay 54 to energize the ignition means 56.

If the flame is re-established, the system goes back into normal operation. If the flame is not re-established, the resistance of the cell means 30 continues to rise and the absolute value of the voltage at the junction 31 is conducted directly to the non-inverting input 151 of the operational amplifier 150 which ultimately will turn the triac 160 on so that conduction occurs through the relay 75 (which has been latched in) and the safety switch heater 74. The heating of the safety switch heater 74 eventually opens the normally closed contact 12 to remove all of the voltage from the flame responsive control circuit means 106 thereby closing the burner down in a safe manner.

Both of the circuits disclosed in FIGS. 1 and 2 rely on a rate of change sensing means to sense the sudden loss of a flame. The two circuits implement the rate of change sensing means in different ways. There are a number of possible ways of further implementing this arrangement and the inventor therefore wishes to be limited in the scope of his invention solely by the scope of the appended claims.

The embodiments of the invention in which an exclusive property or right is claimed are defined as follows:

1. A flame responsive control circuit means adapted to be connected to flame responsive cell means to provide an improved, rapid response to the loss of a flame in burner means and to initiate ignition means upon said flame loss, including: rate of change sensing means having input means adapted to be connected to said cell means to respond to a change in the impedance of said cell means; said rate of change sensing means including amplifier means having output means connected to ignition control switch means; said rate of change sensing means being responsive to the application of an energizing potential to said control circuit means to cause said control circuit means and said ignition control switch means to initiate the operation of said ignition means; said rate of change sensing means further responsive to a rate of change in the impedance of said flame responsive cell means to also initiate said ignition means upon said cell means being first exposed to a flame and subsequently changing impedance rapidly due to the loss of said flame; and fuel control means connected to initiate a supply of fuel to said burner means in response to an absolute potential at said cell means.

2. A flame responsive control circuit means as described in claim 1 wherein said fuel control means has output means including a solid state switch, a relay, and a safety switch heater element connected in a series circuit wherein current conduction of said solid state switch energizes said relay and said heater element; and a normally open relay contact operated by said relay to latch said relay into a further circuit upon operation of said relay.

3. A flame responsive control circuit means as described in claim 1 wherein said cell mens is paralled by a resistor whose value is higher than the resistance of said cell means when said cell means is exposed to a flame in a fuel burner.

4. A flame responsive control circuit means as described in claim 1 wherein said input means for said rate of change sensing means includes said cell means and a capacitor in different legs of a bridge.

5. A flame responsive control circuit means as described in claim 4 wherein said amplifier means includes time delay means to delay the de-energization of said ignition means upon said cell means sensing the presence of flame.

6. A flame responsive control circuit means as described in claim 5 wherein said ignition control switch means includes a relay having a normally open contact for control of said ignition means.

7. A flame responsive control circuit means as described in claim 6 wherein said fuel control means has output means including a solid state switch, a relay, and a safety switch heater element connected in a series circuit wherein current conduction of said solid state switch energizes said relay and said heater element; and a normally open relay contact operated by said relay to latch said relay into a further circuit upon operation of said relay.

8. A flame responsive control circuit means as described in claim 7 wherein said cell means is paralleled by a resistor whose value is higher than the resistance of said cell means when said cell means is exposed to a flame in a burner.

9. A flame responsive control circuit means as described in claim 8 wherein said cell means is a cadmium sulfide photocell; and said fuel burner means is an oil burner.

10. A flame responsive control circuit means as described in claim 1 wherein said input means for said rate of change sensing means includes a coupling capacitor between said cell means and an input for said amplifier means; and said amplifier output means change state in response to a current coupled through said capacitor upon a change in the impedance of said cell means.

11. A flame responsive control circuit means as described in claim 10 wherein said ignition control switch means includes a relay having a normally open contact for control of said ignition means.

12. A flame responsive control circuit means as described in claim 11 wherein said fuel control means has output means including a solid state switch, a relay, and a safety switch heater element connected in a series circuit wherein current conduction of said solid state switch energizes said relay and said heater element; and a normally open relay contact operated by said relay to latch said relay into a further circuit upon operation of said relay.

13. A flame responsive control circuit means as described in claim 12 wherein said cell means is paralled by a resistor by whose value is higher than the resistance of said cell means when said cell means is exposed to a flame in a fuel burner.

14. A flame responsive control circuit means as described in claim 13 wherein said cell means is a cadmium sulfide photocell; and said fuel burner means is an oil burner.

* * * * *

UNITED STATES PATENT OFFICE

CERTIFICATE OF CORRECTION

PATENT NO. : 4,235,587

DATED : November 25, 1980

INVENTOR(S) : GREGORY M. MILES

It is certified that error appears in the above-identified patent and that said Letters Patent are hereby corrected as shown below:

Claim 3, line 2, delete "mens" and insert --means--.

Claim 10, line 5, delete "change" and insert --changes--.

Signed and Sealed this

*Seventeenth* Day of *February 1981*

[SEAL]

*Attest:*

RENE D. TEGTMEYER

*Attesting Officer*

*Acting Commissioner of Patents and Trademarks*